US006400333B2

(12) United States Patent
Ikeda

(10) Patent No.: US 6,400,333 B2
(45) Date of Patent: Jun. 4, 2002

(54) WATERPROOFING AND GAS-PERMEABLE CASE CONSTRUCTION OF SATELLITE-BROADCAST RECEIVING CONVERTER

(75) Inventor: Tomoki Ikeda, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/791,069

(22) Filed: Feb. 22, 2001

(30) Foreign Application Priority Data

Feb. 25, 2000 (JP) ..... 2000-054351

(51) Int. Cl.[7] ..... H01Q 19/12
(52) U.S. Cl. ..... 343/840; 343/872; 333/21 R
(58) Field of Search ..... 343/840, 786, 343/872, 772, 780, 784; 333/21 R, 21 A; H01Q 19/12

(56) References Cited

U.S. PATENT DOCUMENTS 4,896,163 A * 1/1990 Shibata et al. ..... 343/786
5,982,336 A * 11/1999 Wen et al. ..... 343/793
6,127,986 A * 10/2000 Wen et al. ..... 343/820

FOREIGN PATENT DOCUMENTS

| | | |
|---|---|---|
| JP | 10-190491 | 7/1998 |
| JP | 11-186845 | 7/1999 |

* cited by examiner

*Primary Examiner*—Hoanganh Le
(74) *Attorney, Agent, or Firm*—Brinks Hofer Gilson & Lione

(57) ABSTRACT

According to a case construction of the satellite-broadcast receiving converter of the present invention, air from the outside can enter and exit from a housing through a filter by way of a hole. Accordingly, a case and a sealing member can be prevented from being destroyed because of the expansion and contraction of air in the housing and, at the same time, water such as rain entering a cavity through the hole can be prevented from entering the housing deeper by the filter.

8 Claims, 4 Drawing Sheets

WATERPROOFING AND GAS-PERMEABLE CASE CONSTRUCTION OF SATELLITE-BROADCAST RECEIVING CONVERTER

BACKGROUND OF THE INVENTION

1. Field of the Invention

The present invention relates to a waterproofing case construction of a satellite-broadcast receiving converter.

2. Description of the Related Art

Referring to FIG. 9, a conventional case construction of a satellite-broadcast receiving converter will be described. The satellite-broadcast receiving converter 21 comprises a body 23 including a cabinet 22, in which a receiving circuit is accommodated, and a coaxial connector 24 mounted to the body 23 to take electric signals out.

A case 25 comprises first and second molded case members 26, 27 made of synthetic resin. With the body 23 being accommodated in the housing 25*a*, which is formed by combining the first and second case members 26, 27, the connector 24 is provided so as to project outwardly through a hole 26*a* of the first case member 26. Further, the case is so constructed that the hole 26*a* between the connector 24 and the first case 26 is filled with a sealing member 28, the housing 25*a* made up of the first and second cases 26, 27 is completely sealed, and the air does not flow into the housing 25*a* from the outside.

Thus, by completely sealing the housing 25*a* in the case 25, water is prevented from entering the housing 25*a* from the outside.

The satellite-broadcast receiving converter having such construction is brought into an inspection device, and the pressure of the air in the inspection device is increased or reduced to check if the housing 25*a* of the case 25 has leakage of air.

Then, the accepted satellite-broadcast receiving converter under the inspection is put on the market, set outdoors, and used.

However, when a satellite-broadcast receiving converter with the housing 25*a* completely sealed is used outdoors, particularly in summer, at high outdoor temperatures, the air inside the housing 25*a* would expand to destroy the case 25 or the sealing member 28.

The conventional satellite-broadcast receiving converter is so constructed as to completely seal the housing 25*a* of the case 25. Therefore, it has such problems that, particularly in summer, when the outdoor temperature gets higher, the air inside the housing 25*a* expands and destroys the case 25 or the sealing member 28.

SUMMARY OF THE INVENTION

It is therefore an object of the present invention to provide a case construction of a satellite-broadcast receiving converter in which the case or the sealing member is not destroyed and waterproofing of the housing is possible.

As a first embodiment to solve the above problems, the case construction of a satellite-broadcast receiving converter comprises a satellite-broadcast receiving converter having a body and a connector, and a case having a housing to accommodate the body; wherein the connector of the satellite-broadcast receiving converter projects outwardly from the case while an entire portion of the body being covered with the case, a portion of the case includes a cavity provided between an inner part and an outer part of the case, a closing part so formed as to close the outer part of the cavity and a hole so made in the closing part as to provide communication between the outside of the case and the cavity, and the inner part of the cavity is closed with a waterproofing and gas-permeable filter.

Further, as a second embodiment, the filter is disposed so as not to oppose a face of the closing part.

Further, as a third embodiment, the closing part is formed of a thin wall.

Further, as a fourth embodiment, the closing part is formed on the outer surface of the case and the filter is provided on the inner surface of the case.

Further, as a fifth embodiment, the filter is affixed to the case by adhesive.

Further, as a sixth embodiment, the filter is supported by a cabinet making up the body of the satellite-broadcast receiving converter.

Further, as a seventh embodiment, a face of the closing part is disposed perpendicularly to the projecting direction of the connector from the case.

Further, as an eighth embodiment, the closing part is positioned in the vicinity of the connector.

DESCRIPTION OF THE PREFERRED EMBODIMENT

Figure 2:
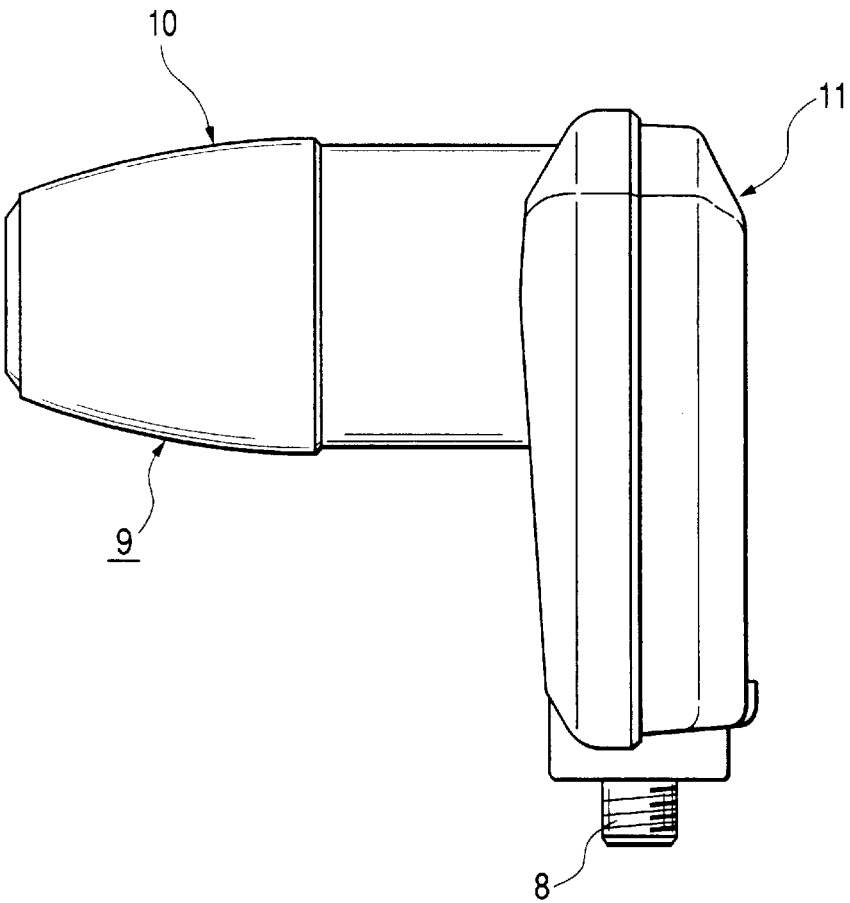
FIG. 2 is a side view of the case construction of the satellite-broadcast receiving converter of the invention according to the first example.
Figure 1:
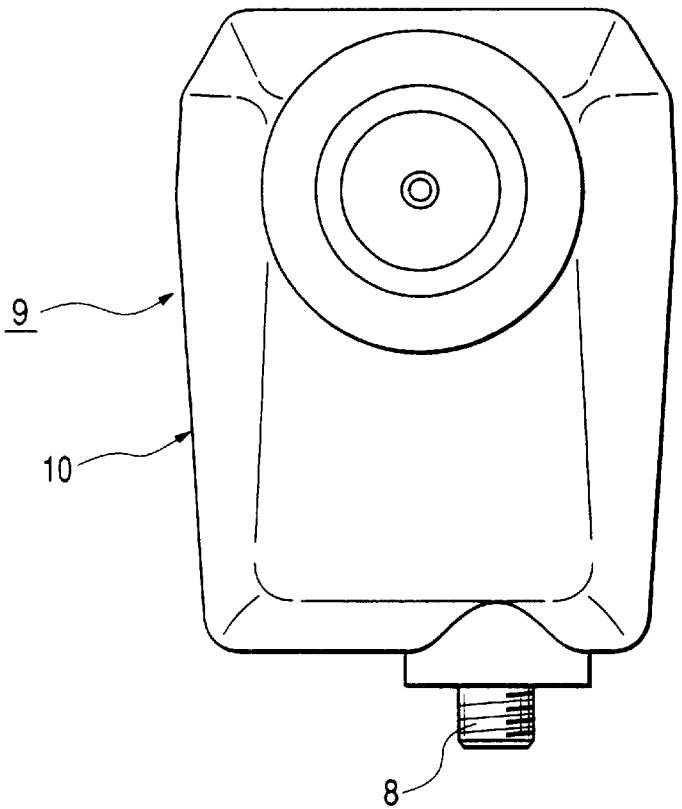
FIG. 1 is a front view of a case construction of a satellite-broadcast receiving converter of the invention according to a first example.
Figure 3:
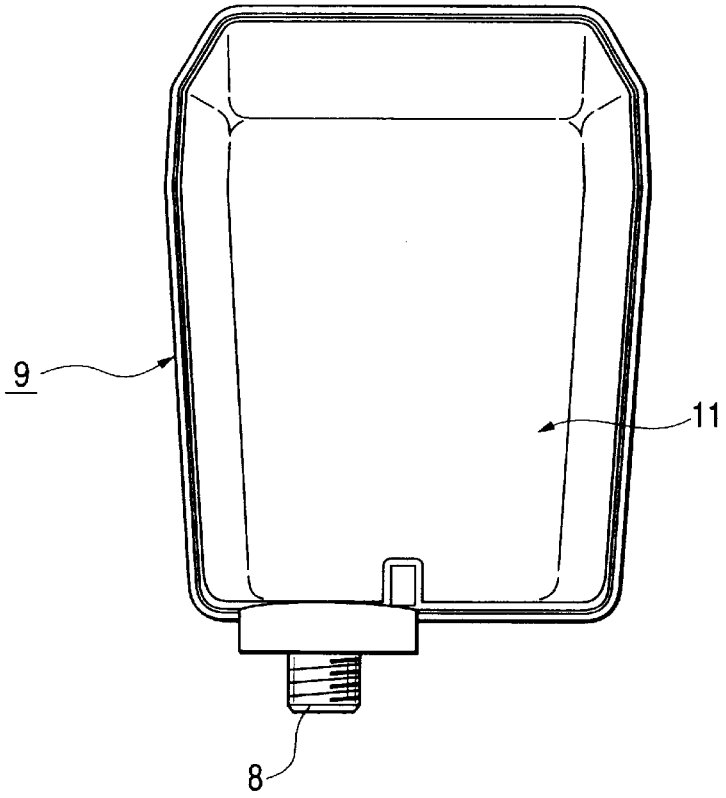
FIG. 3 is a reverse-side view of the case construction of the satellite-broadcast receiving converter of the invention according to the first example.
Figure 4:
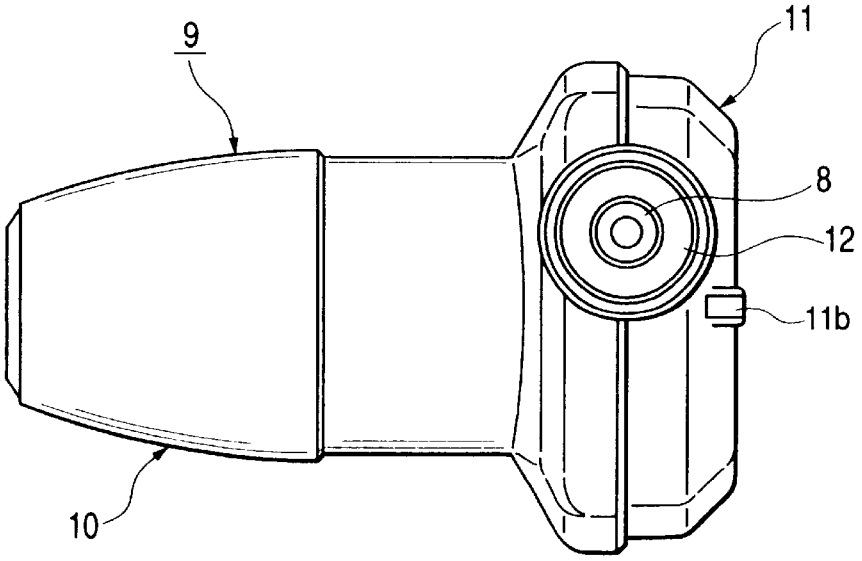
FIG. 4 is an underneath view of the case construction of the satellite-broadcast receiving converter of the invention according to the first example.

Now, the drawings for a case construction of a satellite-broadcast receiving converter of the present invention will be described. FIG. 1 is a front view of a case construction of a satellite-broadcast receiving converter according to a first example. FIG. 2 is a side view of the case construction of the satellite-broadcast receiving converter of the invention according to the first example. FIG. 3 is a reverse-side view of the case construction of the satellite-broadcast receiving converter of the invention according to the first example. FIG. 4 is an underneath view of the case construction of the satellite-broadcast receiving converter of the invention according to the first example.

Figure 5:
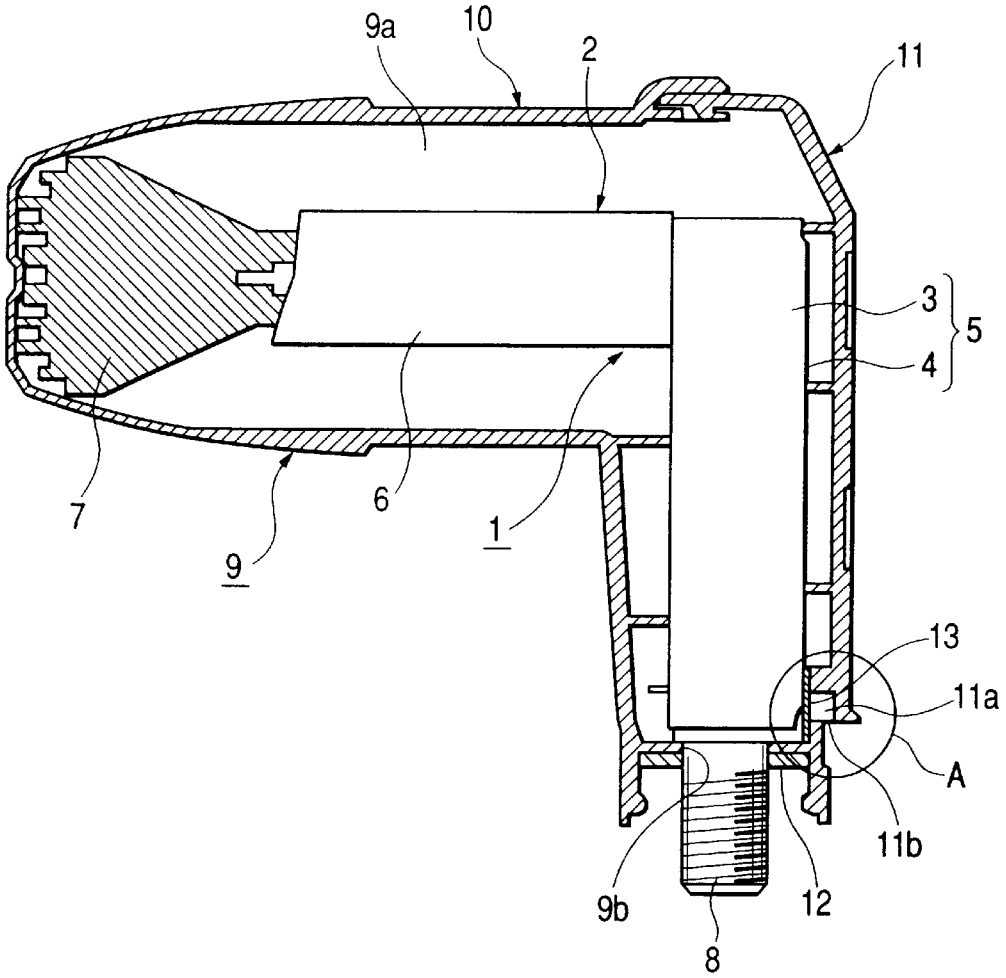
FIG. 5 is a sectional view of a principal part of the case construction, as viewed sideways, of the satellite-broadcast receiving converter of the invention according to the first example.
Figure 6:
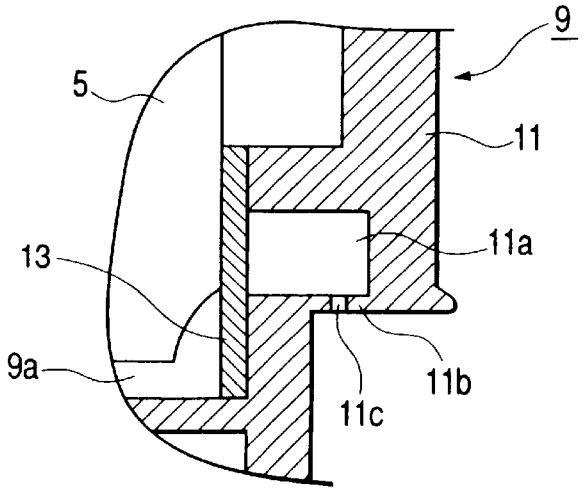
FIG. 6 is an enlarged sectional view of a principal part of detail A of FIG. 5.
Figure 7:
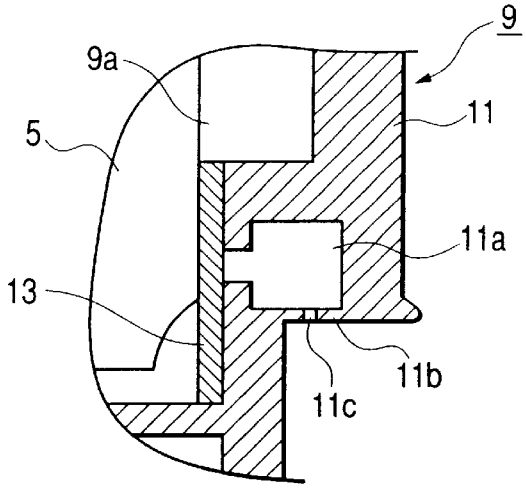
FIG. 7 is an enlarged sectional view of a principal part of a case construction of a satellite-broadcast receiving converter of the invention according to a second example.
Figure 8:
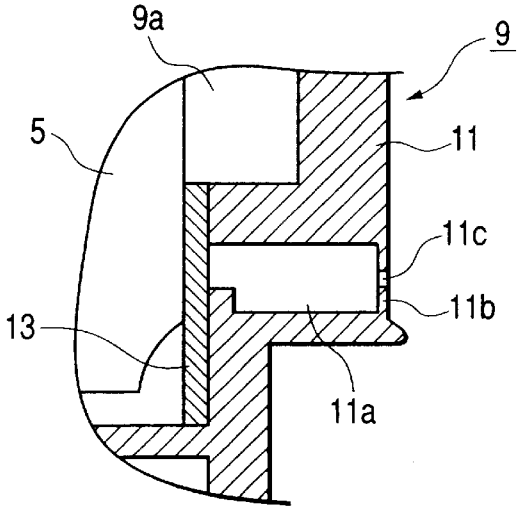
FIG. 8 is an enlarged sectional view of a principal part of a case construction of a satellite-broadcast receiving converter of the invention according to a third example.
Figure 9:
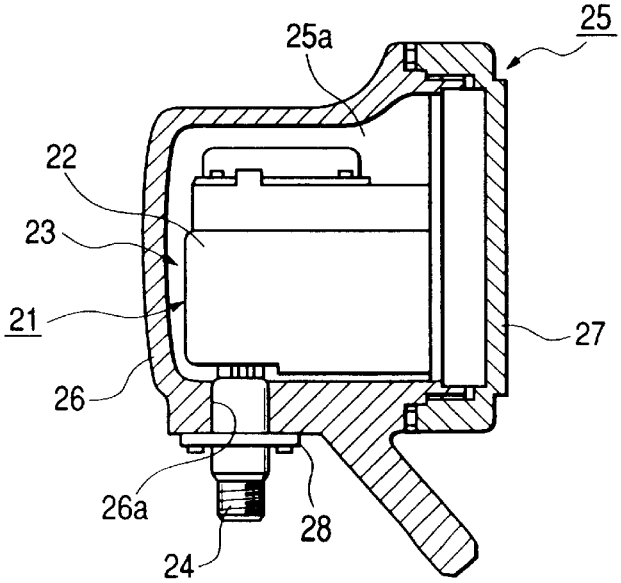
FIG. 9 PRIOR ART
FIG. 9 is a sectional view of a principal part showing a case construction of a conventional satellite-broadcast receiving converter.

Further, FIG. 5 is a sectional view of a principal part of the case construction, as viewed sideways, of the satellite-broadcast receiving converter of the invention according to the first example. FIG. 6 is an enlarged sectional view of a principal part of A-portion of FIG. 5. FIG. 7 is an enlarged sectional view of a principal part of a case construction of a satellite-broadcast receiving converter of the invention according to a second example. FIG. 8 is an enlarged sectional view of a principal part of a case construction of a satellite-broadcast receiving converter of the invention according to a third example.

Referring to FIGS. 1 to 6, the first example of the case construction of the satellite-broadcast receiving converter of the invention will be described. The satellite-broadcast receiving converter 1 comprises a body 2 and a coaxial connector 8 mounted to the body 2.

The body 2 comprises a frame 3 made up of a metal plate and a cover 4 made up of a metal plate. It further comprises a box-shaped cabinet 5 accommodating a receiving circuit, a tubular waveguide 6 projecting perpendicularly from the cabinet 5, and a feeder 7 made of an insulating material mounted on a tip of the waveguide 6.

The coaxial connector 8 is mounted to an end face of the cabinet 5 so as to take electric signals out.

The case 9 comprises a first and second molded case members 10, 11 made of synthetic resin. Further, with the body 2 being accommodated in the housing 9*a*, which is formed by combining the first and second case members 10, 11, the connector 8 is provided so as to project outwardly through a hole 9*b* in the case 9.

The first case member 10 covers the feeder 7, the waveguide 6 and a front portion of the cabinet 5, and the second case member 11 covers a rear portion of the cabinet 5. Further, the hole 9*b* between the connector 8 and the case 9 is filled with the sealing member 12, and the housing 9*a* made up of the first and second case members 10, 11 is sealed.

Further, a portion of the second case member 11 includes a cavity 11*a* provided between an inner part or the housing 9*a* of the case 9 and an outer part or an outer portion of the case 9, and a closing part 11*b* made up of a thin wall provided so as to close the outer part of the cavity 11*a*.

Further, the closing part 11*b* is provided in the vicinity of the connector 8 and on the outer surface of the second case member 11. Also, a face of the closing part 11*b* is disposed perpendicularly to the projecting direction of the connector 8 of the case 9.

The filter 13 is made of waterproofing and gas-permeable material such as, for example, a porous material made of polytetrafluoro-ethylene resin. Adhesive (not shown) is applied on one face of the filter 13, and the filter is affixed to the inner surface of the case 9, or the inner side of the cavity 11*a*, in such a way that it closes the cavity 11*a*.

Then, the inner surface of the affixed filter 13 is in contact with the cabinet 5, and the filter 13 is supported while being pressed to the case 9 by the cabinet 5.

The face with an affixed filter 13 closing the cavity 11*a* and the closing part 11*b* provided outside are disposed perpendicularly with each other, and the filter 13 is disposed so as not to oppose the face of the closing part 11*b*.

Then, a small hole 11*c* is made in the closing part 11*b* made up of a thin wall with a pointed jig (not shown). Thus, the outside of the case 9 and the cavity 11*a* are in communication through the hole 11*c*.

Since the filter 13 is disposed so as not to oppose the face of the closing part 11*b*, the jig does not contact the filter 13 when a hole is opened with it. Therefore, the filter 13 is prevented from being damaged by the jig.

Further, be cause of the hole 11*c*, air from the outside can enter and exit from the housing 9*a* through the filter 13. Accordingly, the case 9 and the sealing member 12 can be prevented from being destroyed by the expansion and contraction of the air in the housing 9*a*. Also, water such as rain entering the cavity 11*a* through the hole 11*c* is prevented from entering the housing 9*a* by the filter 13.

Further, in the case when the hole 11*c* is not provided, the case is constructed such that the housing 9*a* is completely sealed and the exterior air does not enter the housing 9*a*.

In an inspection process, a satellite-broadcast receiving converter, of which case is without the hole 11*c*, is brought into an inspection device. Then, by increasing and reducing the pressure to the air in the inspection device, leakage of air in the housing 9*a* of the case 9 is checked.

A small hole 11*c* is made by a jig in the closing part 11*b* of the accepted satellite-broadcast receiving converter under the inspection so that the air can freely move between the housing 9*a* and the outside through the filter 13.

Thus, in the case of using the satellite-broadcast receiving converter outdoors, even when air in the housing 9*a* expands, particularly in summer, the air moves through the hole 11*c* in the filter 13 to prevent the case 9 and the sealing member 12 from being destroyed. Also, the housing 9*a* can be waterproofed by means of the filter 13.

When setting the satellite-broadcast receiving converter 1 outdoors, the feeder 7 is mounted so as to face the direction of a satellite with the connector 8 underside. Therefore, if the face of the closing part 11*b* is provided perpendicularly to the projecting direction of the connector 8 of the case 9, the closing part 11*b* is positioned underside, preventing water such as rain from entering deeper through the hole 11*c*.

FIG. 7 shows a second example of the present invention. In the example, the inner part of the cavity 11*b* closed by the filter 13 is made small to prevent the entering water in the cavity 11*b* from reaching the filter 13 directly. Since the rest of the construction is similar to the example described above, like numbers are given to like parts and the description for them is omitted here.

FIG. 8 shows a third example of the present invention. In the example, the filter 13 and the closing part 11*b* are opposed across the cavity 11*a*. In the rest of the construction, like numbers are given to like parts of the first example and the description for them is omitted here.

The case construction of the satellite-broadcast receiving converter according to the present invention comprises a cavity 11*a* provided in a portion of the case 9 between the inner part and the outer part of the case 9, a closing part 11*b* formed so as to close the outer part of the cavity 11*a*, and a hole 11*c* made in the closing part 11*b* to provide communication between the outside of the case 9 and the cavity 11*a*. Also, the inner part of the cavity 11*a* is closed by the filter 13, which is both waterproofing and gas-permeable and, by way of the hole 11*c*, the air from the outside can enter and exit from the housing 9*a* through the filter 13. Thus, the case 9 and the sealing member 12 are prevented from being destroyed by the expansion and contraction of the air in the housing 9*a* and, at the same time, water such as rain entering the cavity 11*a* through the hole 11*c* is prevented from entering the housing 9*a* by the filter 13.

Also, according to the construction such as described above, without altering the inspection method, leakage of air in the housing 9*a* of the case 9 can be checked by using a conventional inspection device.

Further, since the filter 13 is disposed so as not to oppose the face of the closing part 11*b*, a jig does not contact the filter 13 when making a hole 11*c* in the closing part 11*b* with it, and the filter 13 can be provided without being damaged by the jig.

Further, since the closing part 11*b* is formed of a thin wall, it is easy to make a hole 11*c* in it and the one with good workability can be provided.

Further, since the closing part 11*b* is formed on the outer surface of the case 9 and the filter 13 is provided on the inner surface, a distance between the filter 13 and the closing part 11*b* can be made long enough, and the filter 13 without being damaged by the jig can be provided.

Further, since the filter 13 is affixed to the case 9 by adhesive, mounting of the filter 13 is easy and, at the same time, the housing 9*a* adequately sealed by the filter 13 can be provided.

Further, since the filter 13 is supported by the cabinet 5 making up the body 2 of the satellite-broadcast receiving converter 1, the filter 13 is prevented from coming off so that the filter 13 which does not peel off for a long time can be provided.

Further, since the face of the closing part 11*b* is disposed perpendicularly to the projecting direction of the connector 8 from the case 9, the closing part 11*b* is positioned underside. Therefore, the construction in which water such as rain via the hole 11*c* is prevented from entering deeper can be provided.

Further, since the closing part 11*b* is provided in the vicinity of the connector 8, the closing part 11*b* is close to the lowest portion of the case 9. Thus, the construction in which water such as rain via the hole 11*c* is prevented from entering deeper can be provided.

What is claimed is:

1. A case construction of a satellite-broadcast receiving converter, comprising: a satellite-broadcast receiving converter having a body and a connector, and a case having a housing to accommodate the body;

wherein the connector of the satellite-broadcast receiving converter projects outwardly from the case while an entire portion of the body being covered with the case, a portion of the case includes a cavity provided between an inner part and an outer part of the case, a closing part so formed as to close the outer part of the cavity and a hole so made in the closing part as to provide communication between the outside of the case and the cavity, and the inner part of the cavity is closed with a waterproofing and gas-permeable filter.

2. A case construction of a satellite-broadcast receiving converter according to claim 1, wherein the filter is disposed so as not to oppose a face of the closing part.

3. A case construction of a satellite-broadcast receiving converter according to claim 1, wherein the closing part is formed of a thin wall.

4. A case construction of a satellite-broadcast receiving converter according to claim 1, wherein the closing part is formed on the outer surface of the case and the filter is provided on the inner surface of the case.

5. A case construction of a satellite-broadcast receiving converter according to claim 1, wherein the filter is affixed to the case by adhesive.

6. A case construction of a satellite-broadcast receiving converter according to claim 5, wherein the filter is supported by a cabinet making up the body of the satellite-broadcast receiving converter.

7. A case construction of a satellite-broadcast receiving converter according to claim 1, wherein a face of the closing part is disposed perpendicularly to the projecting direction of the connector from the case.

8. A case construction of a satellite-broadcast receiving converter according to claim 7, wherein the closing part is positioned in the vicinity of the connector.

* * * * *